US007624598B2

(12) United States Patent
Dehner et al.

(10) Patent No.: US 7,624,598 B2
(45) Date of Patent: Dec. 1, 2009

(54) LATCH NEEDLE

(75) Inventors: Lothar Dehner, Hechingen (DE); Thomas Schmid, Balingen (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 12/320,781

(22) Filed: Feb. 4, 2009

(65) Prior Publication Data

US 2009/0173109 A1 Jul. 9, 2009

(30) Foreign Application Priority Data

Feb. 5, 2008 (EP) ..... 08002103

(51) Int. Cl.
*D04B 35/04* (2006.01)

(52) U.S. Cl. ..... 66/121

(58) Field of Classification Search ..... 66/116, 66/119, 122

See application file for complete search history.

(56) References Cited

U.S. PATENT DOCUMENTS

| | | | | |
|---|---|---|---|---|
| 2,252,302 | A * | 8/1941 | Morith | 66/117 |
| 3,050,968 | A * | 8/1962 | Masujima | 66/121 |
| 4,791,794 | A * | 12/1988 | Schmoll | 66/121 |
| 4,827,739 | A * | 5/1989 | Goller et al. | 66/64 |
| 5,956,976 | A * | 9/1999 | Schaffer et al. | 66/121 |
| 6,439,001 | B1 * | 8/2002 | Schaffer | 66/121 |
| 6,510,714 | B2 * | 1/2003 | Dehner | 66/121 |
| 6,792,775 | B2 * | 9/2004 | Wang | 66/121 |
| 6,931,890 | B2 * | 8/2005 | Stingel et al. | 66/121 |
| 7,191,620 | B2 * | 3/2007 | Jurgens et al. | 66/121 |
| 2006/0075788 | A1 | 4/2006 | Jurgens et al. | |

FOREIGN PATENT DOCUMENTS

| | | |
|---|---|---|
| DE | 12 490 C | 2/1881 |
| DE | 101 06 989 A1 | 9/2002 |
| DE | 102004049061 | 4/2006 |

* cited by examiner

*Primary Examiner*—Danny Worrell
(74) *Attorney, Agent, or Firm*—Fitch, Even, Tabin & Flannery; Norman N. Kunitz

(57) ABSTRACT

The latch needle in accordance with the invention comprises a needle tongue with an integrated spring that is configured as the functional element on the needle tongue. No separate tongue spring, whatsoever, need be accommodated in the saw slot. This novel needle concept is robust and suitable for high operating speeds.

6 Claims, 5 Drawing Sheets

LATCH NEEDLE

CROSS-REFERENCE TO RELATED APPLICATION

The present application claims the priority of European Patent Application No. 08 002 103.3, filed Feb. 5, 2008, the subject matter of which, in its entirety, is incorporated herein by reference.

BACKGROUND OF THE INVENTION

The invention relates to a latch needle with a needle tongue comprising an integrated tongue spring.

Knitting machines or other stitch-forming systems are frequently equipped with latch needles that comprise a tongue spring. For example, DE 10 2004 049 061 A1 discloses such a latch needle. On its end, the needle body is provided with a hook. Located near the hook is a saw slot in which the needle tongue is pivotally supported. Arranged near the tongue bearing is a leaf spring that extends in longitudinal direction through the saw slot and whose ends are held on the needle body. The tongue spring pushes against the bearing-side end of the needle tongue and causes the needle tongue to have two rest positions in the vicinity of their end positions. When the needle tongue is in its rest position, it projects slightly from its end position.

DE 101 06 989 C2 also shows such a latch needle. Again, the needle tongue is disposed to act to resiliently displace the needle tongue away from its end positions.

Inasmuch as the tongue spring extends through the saw slot, problems may occur when the latch needle is subject to serious soiling. The objective is to carry debris in the form of fiber residue, abraded material, etc., that has entered the saw slot back out of the saw slot. If the saw slot is closed on its rear side by the tongue spring, this can lead to problems.

SUMMARY OF THE INVENTION

Therefore, it is the object of the invention to provide an improved latch needle. This object is generally achieved with a latch needle in accordance with the invention that comprises a needle body, as well as a needle tongue, that is movably supported on said needle body, said needle tongue comprising at least one spring element. The spring element is associated with the needle tongue and moves with said tongue. Thus, said spring element does not create a barrier that could impair the debris from passing through or from exiting from the saw slot, as is the case in prior art. As is the case in other latch needles that comprise a spring element, the spring element of the latch needle in accordance with the invention also is disposed to bring the needle tongue—in at least one of its end positions—into a position that is slightly lifted off the needle body. This is achieved by the tongue spring in that it exerts a corresponding force on the tongue shaft. In so doing, said tongue spring may abut against the needle body which comprises abutment or support surfaces corresponding thereto.

Above and beyond the improved transport of fuzz or other abraded material or debris out of the saw slot, the invention features another advantage. In particular in the case of high production speeds, the otherwise occasionally occurring tongue resilience loss can be prevented. An additional tongue spring in the saw slot is completely unnecessary.

Considering a preferred embodiment, the spring element is configured as a one-piece component of the needle tongue. As a result of this, the spring element is connected to the needle tongue so that it may not be lost. Even at high operating speeds, it is not possible for the spring element to detach from the needle tongue. Rather, said spring element is a part of the needle tongue and preferably consists of the same material as said needle tongue. Now, because the saw slot does not need to accommodate a tongue spring, said saw slot may be configured independently of the tongue spring. It is possible to configure the saw slot so that several cutouts terminate in each other, whereby one or more connections between the slot walls continue to remain. These connections may act as abutments for the needle tongue or its spring element, on the one hand, or may act as a stiffening element for stabilizing the slot walls relative to each other and for stiffening the needle, on the other hand.

As mentioned, the spring element may consist of a section of the needle tongue itself. However, alternatively, it is also possible to provide a spring element of the same or a different material on the needle tongue. For example, one or more spring elements, e.g., leaf spring elements, may be welded to the needle tongue.

The needle tongue has a bearing section and a head. The head may be configured, e.g., like a spoon in order to receive the tip of the hook of the needle. Alternatively, the head may be configured as a small strip that fits into a longitudinal groove of the hook, said groove also being referred to as a "small recess". The bearing section and the head may be rigidly connected to each other, whereas the spring element—for example, starting at the head—extends to the bearing section and, optionally, past said bearing section or around said bearing section. The spring element may be designed as a leaf spring or as a spring tongue. The spring element may be a U-shaped element that extends around the bearing section, whereby two legs of the U-shaped element are connected, e.g., to the head of the needle tongue. In so doing, said element forms a U-shaped bracket that may support the tongue in both its end positions in a resilient manner. The spring element is resiliently displaced in radial direction relative to the bearing pin of the latch needle.

Alternatively or additionally, it is also possible to configure the connection between the bearing section and the head of the needle tongue as the spring element, e.g., as the small strip that acts as a flexible spring. In so doing, additional spring actions may be achieved. As a result, the stiffness of the spring may be adjusted within wide limits. It may be made relatively minimal, without requiring that the spring elements be cut too thin.

Additional details of advantageous embodiments of the invention are the subject matter of the drawing, the description and the claims. The description is restricted to essential aspects of the invention and miscellaneous situations. The drawings disclose additional details and are to be referred to as being supplementary.

DETAILED DESCRIPTION OF THE INVENTION

Figure 1:
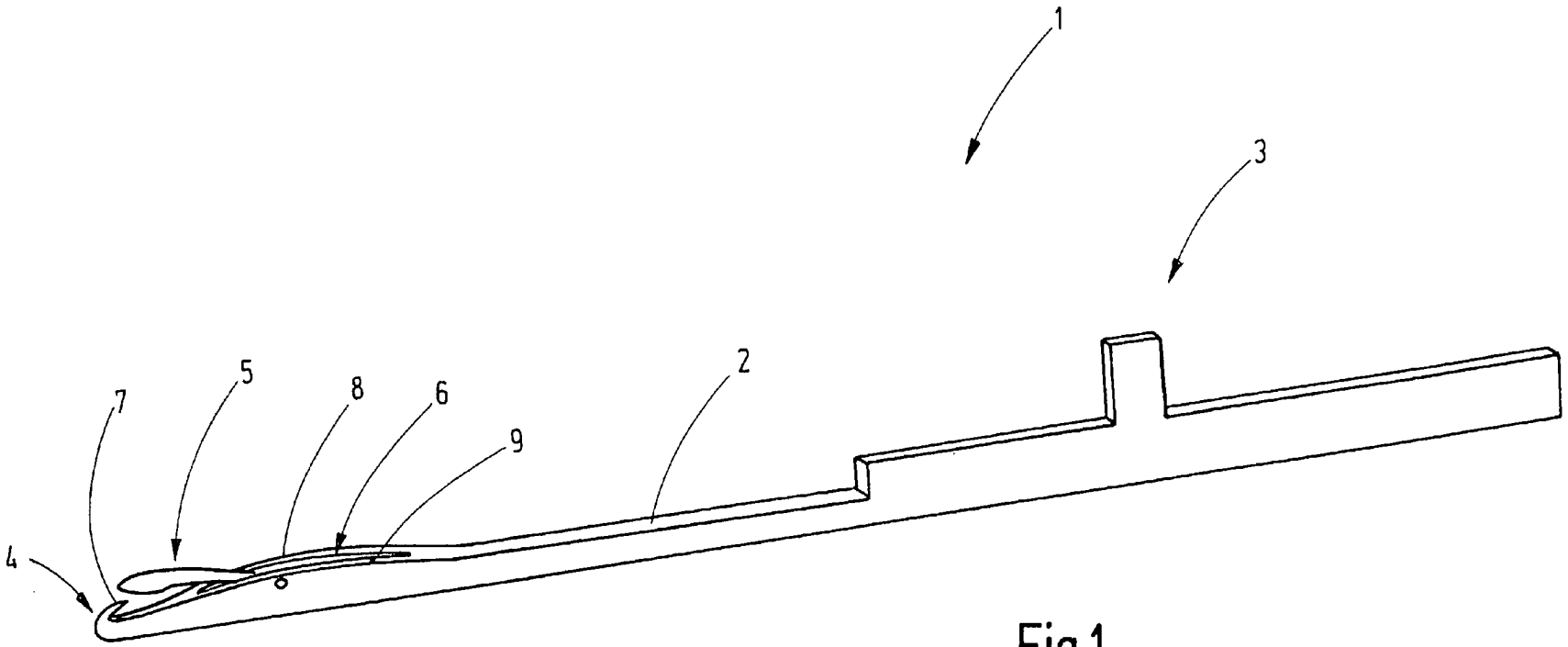
FIG. 1 is a schematic, perspective illustration of the latch needle in accordance with the invention.

FIG. 1 shows a latch needle 1 for use in a knitting machine, for example, a circular knitting machine, a flat-bed knitting machine or also for use in any other loop-forming system. The latch needle 1 comprises a needle body 2 that is disposed to be set into the needle channel of a needle bed. The needle body 2 has a foot 3 that is disposed to drive or position the latch needle 1 and, in order to accomplish this, comes into engagement with a not specifically illustrated needle lock or other positioning means that are being used. The needle body 2 forms a shaft that has a hook 4 on its free end. The hook 4 is associated with a needle tongue 5 that is pivotally held in a saw slot 6. In one extreme position, the needle tongue 5 can come into engagement with the tip/hook 4 in order to close the inside space of the hook. In addition, said tongue can be pivoted far away from the tip 7 in order to clear the hook 4.

Figure 2:
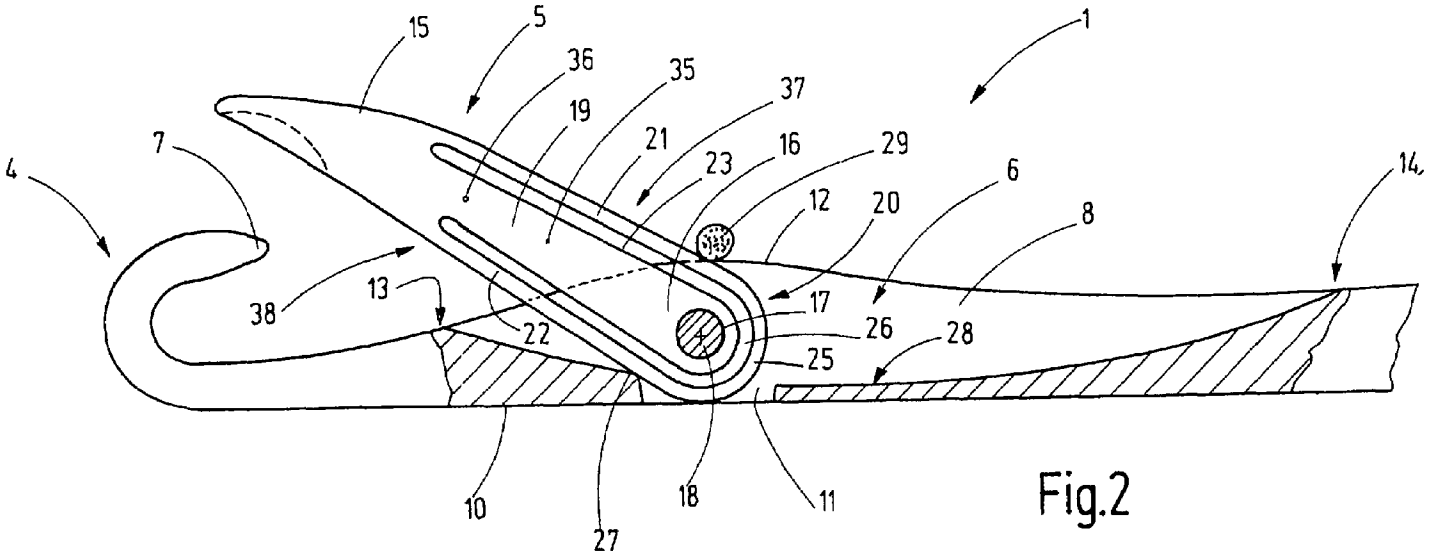
FIGS. 2-5 are side elevational and sectional views in longitudinal direction in the region of the saw slot, respectively, of the latch needle in accordance with FIG. 1 in different operating positions.

FIG. 2 illustrates the latch needle 1 in accordance with FIG. 1 in a different size and in section along the saw slot 6 that is delimited by to slot walls 8, 9. The needle slot 6 terminates in an opening 11 that extends through to the needle back 10. The opening 11, preferably with respect to the axial direction of the latch needle 1, is shorter than the length of the saw slot 6 that extends on the needle breast 12 from a hook-side end 13 to an opposite end 14.

Figure 3:
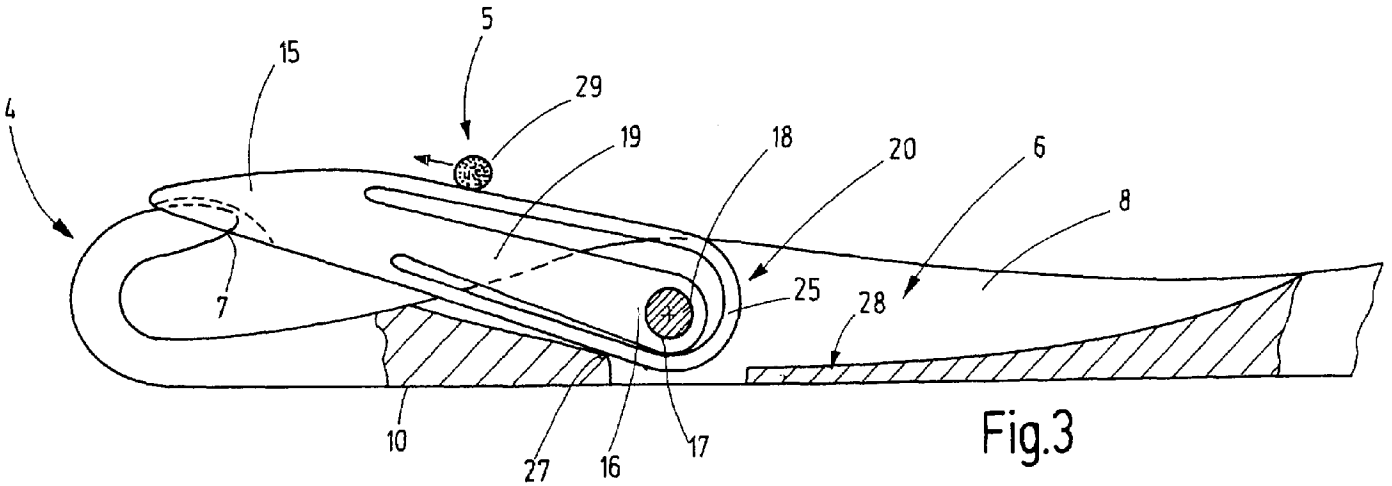

The needle tongue 5 is inherently resilient. It has an approximately rectangular planar basic shape that is delimited by two large flat lateral surfaces 35 and 36, said surfaces being essentially parallel at a distance from each other, as well as by two narrow flat sides, the tongue back 37 and the inside edge 38 of the tongue shaft. The flat sides 35 and 36 are connected to each other via the tongue back 37 and the inside edge 38 of the needle tongue. All edges are rounded and smoothed so that damage to the yarn that is being processed cannot occur or is almost precluded. At its end, the needle tongue 5 has a head 15 which, in closed position as shown in FIG. 3, abuts against the hook 4. In so doing, the tip 7 may be accommodated by a spoon section of the head 5, as shown by FIG. 3.

In addition, the needle tongue 5 has a tongue shaft that has, on the end remote from the head 15, a bearing section 16 where the needle tongue 5 is provided with a bearing opening 17. The latter preferably extends as a cylindrical bore transversely through the needle tongue 5. A pin 18 extends—with minimal play—through the bearing opening 17 and thus forms a pivot bearing for the needle tongue 5. The pin 18 is connected to the slot walls 8, 9.

Considering the present exemplary embodiment, the bearing section 16 and the head 15 are connected to each other via a rigid strip 19. The bearing section 16, the strip 19 and the head 15, in so doing, adjoin each other seamlessly and in one piece.

A spring element 20 projects from the head 15. In the present exemplary embodiment, the spring element 20 forms a U-shaped bracket with two straight legs 21, 22 that, together with the strip 19, delimit the slits 23, 24, respectively. A connecting section 25 preferably having the shape of a circular arc connects the two legs 21, 22 to each other and extends around the bearing-side end of the bearing section 16. An arcuate slit 26 exists between said two legs. As illustrated, the needle tongue 5 may consist of a single metal piece having a spring element configured such that it has slits 23, 24, 26. Together, these slits 23, 24, 26 form a U-shaped cutout, e.g., having a constant width, said cutout extending around the bearing section 16 and along the strip 19. Through this cutout that completely extends through the needle tongue, i.e., it terminates in the two flat sides 35, 36, the legs 21, 22 and the connecting section 25 are cleared. Preferably, the legs 21, 22 have a uniform thickness that is to be measured, respectively at a right angle to the adjacent slit. The width of the legs 21, 22 and the connecting section 25 to be measured parallel to the pin 18 corresponds locally preferably to the width of the needle tongue 5, and thus to the distance between the two flat sides 35 and 36. However, the legs 21, 22 and the connecting section 25 may also have a width different from the distance of the flat sides 35 and 26. For example, in order to increase the spring effect, or for other reasons, they may also have a reduced width.

On the bottom of the saw slot 6 there are—preferably on both sides of the opening 11—abutment surfaces 27, 28 that are positioned in such a manner that the needle tongue 5 will come in abutment there before it has reached its respective end position. The two abutment surfaces 27, 28, viewed relative to the longitudinal direction of the needle length, are provided in front of and behind the bearing pin 18 that is in direct alignment with the opening 11, or above said opening (with respect to the illustration of FIG. 2).

The latch needle described so far operates as follows:

FIG. 1 shows the needle tongue 5 in its front rest position, i.e., adjacent to the hook 4. The section of the leg 22 located close to the pin 18 is in contact with the abutment surface 27. A thread 29 that belongs to a half stitch picked up by the latch needle 1 moves over the tongue back 37 in the direction of the hook 4. The head 15 of the needle tongue 5 initially does not touch the tip 7 of the hook 4, but, as shown by FIG. 2, is at a certain distance from said tip.

If now the thread 29 continues to travel in the direction of the hook 4, the needle tongue 5 is pushed into its end position, as shown by FIG. 3. This is done against the force of the spring element which will deform as a result of this. In particular, it deforms in view of its position relative to the strip 19, in that it is pushed against the bearing section 16. The head 15 is pushed against the tip 7 of the hook 4, so that the inside space of the hook is completely closed and that the thread 29 may slide off the needle tongue.

As soon as the thread 29 has left the needle tongue 5, said tongue jumps back into its rest position in accordance with FIG. 2, as a result of the force exerted by the spring element 20.

Figure 4:
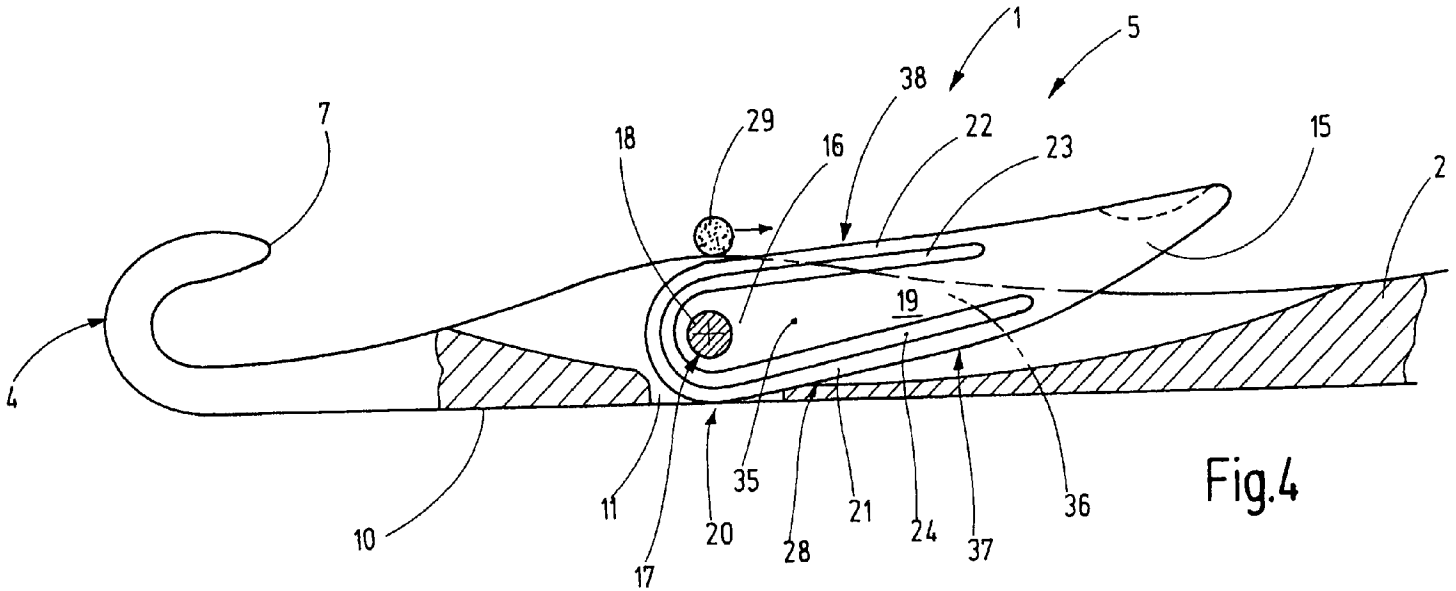

FIG. 4 illustrates the rear rest position of the needle tongue 5. The outside of the leg 21 of the spring element 20 abuts against the abutment surface 28. The head 15 projects slightly from the needle body 2.

Figure 5:
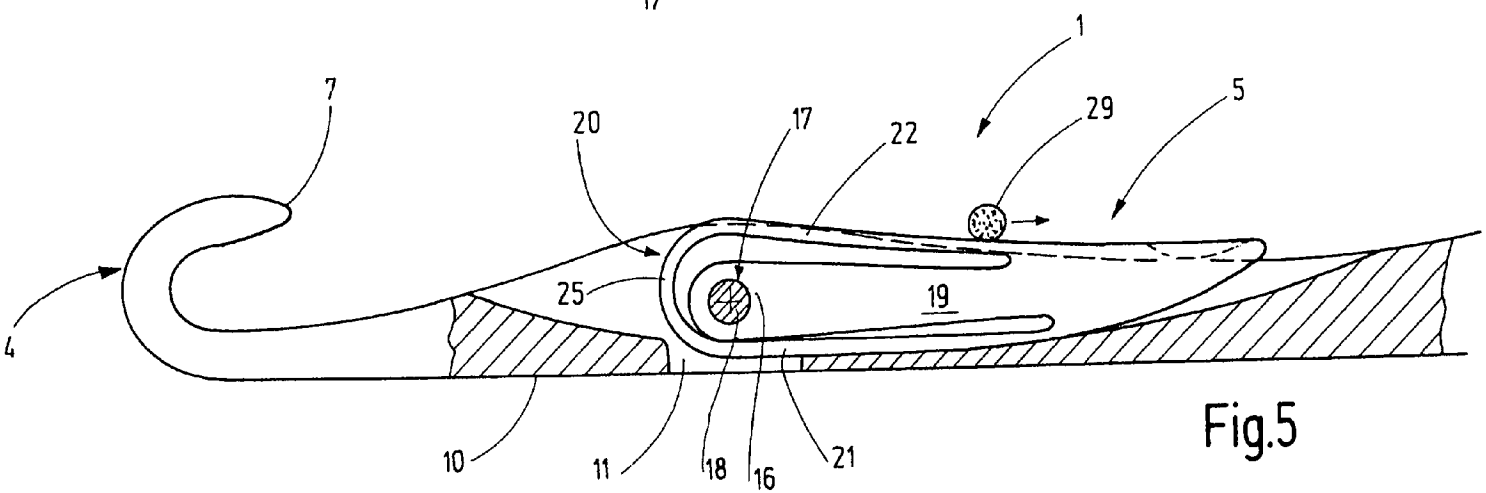

However, if the thread 29 moves over the inside edge 38 of the needle tongue 5 farther away from the hook 4 as shown by FIG. 5, it pushes the needle tongue 5 against the force of the spring element 20, while deforming said element, past its rear rest position into the shaft-side end position. However, when the thread 29 has then slid down off the needle tongue 5, the spring element 20 again pushes the needle tongue 5 out of the position in accordance with FIG. 5 and back into the position in accordance with FIG. 4.

To this extent, the spring element 20 performs the function of a tongue spring just like the separate tongue spring in latch needles in accordance with DE 10 2004 049 061 A1 or DE 101 06 989 C2. However, different from prior art, the spring element 20 does not block the passage through the saw slot 6.

Rather, the opening 11 is open. Dirt, dust, abraded material and the like can be easily transported through the opening 11 and out of the saw slot 6.

Figure 6:
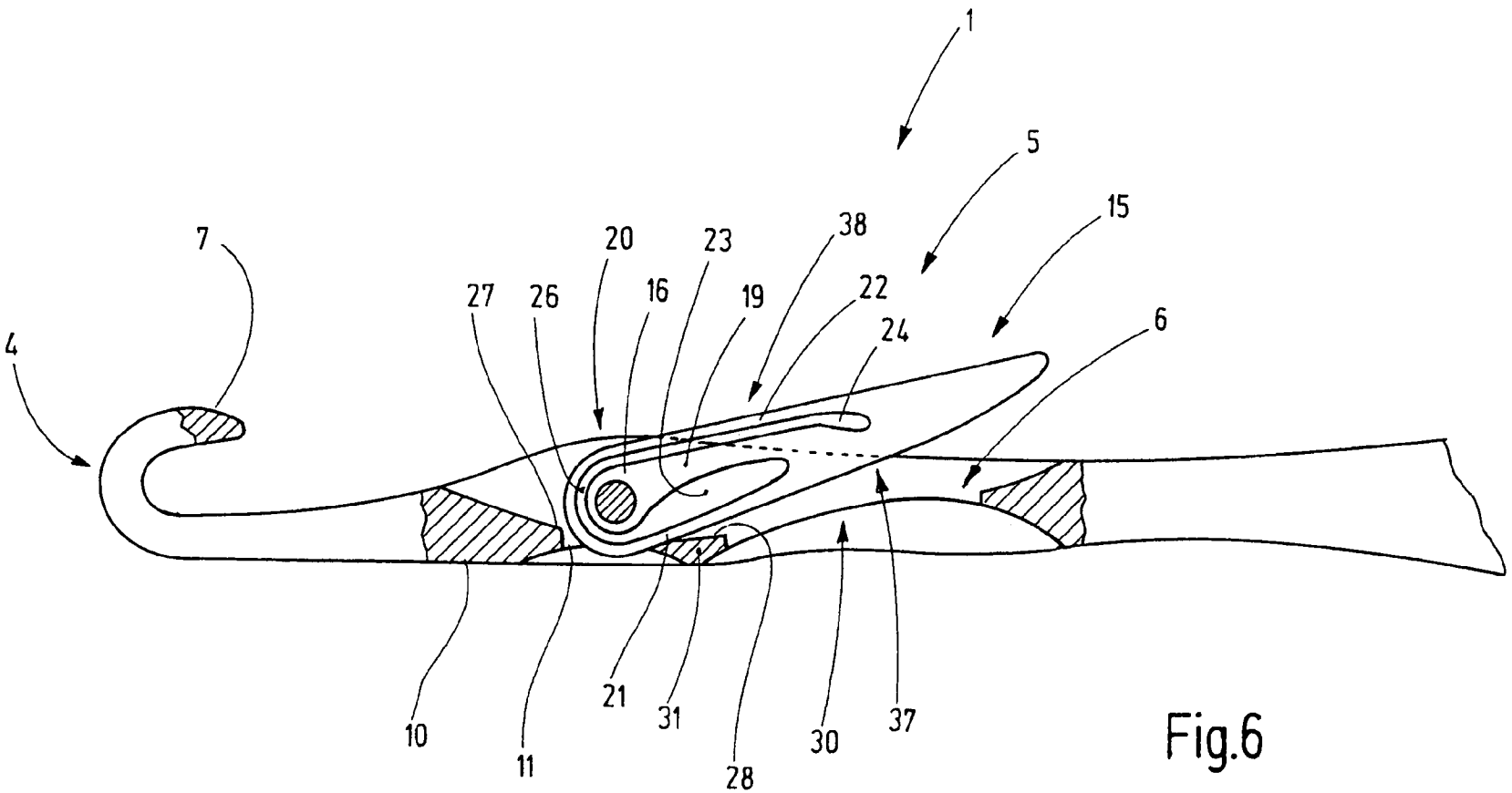
FIGS. 6-9 are side elevational and sectional views in longitudinal direction in the region of the saw slot, respectively, of alternative embodiments of the latch needle in accordance with the invention.

In order to enhance this effect, it is also possible, in accordance with FIG. 6, to provide the bottom of the saw slot 6 not only with one opening 22 but, optionally, with several openings. In the presented exemplary embodiment, a second opening 30 is provided, said opening connecting the needle back 10 with the saw slot 6. Among each other, the openings 11, 30 are separated from each other by a strip 31 that connects the two lateral cheeks 8, 9 to each other (FIG. 1). The abutment surface 28 is provided on the strip 31. The strip 19 is slimmer than in the case of the previous exemplary embodiments. The slits 23, 24, 26 have different sizes and shapes and, again, clear the spring element 20. The legs 21, 22 may have different lengths and become slightly thicker toward the head 15. Other than that, the above description of FIGS. 1 through 5 is analogously applicable with the use of the same reference signs.

Figure 7:
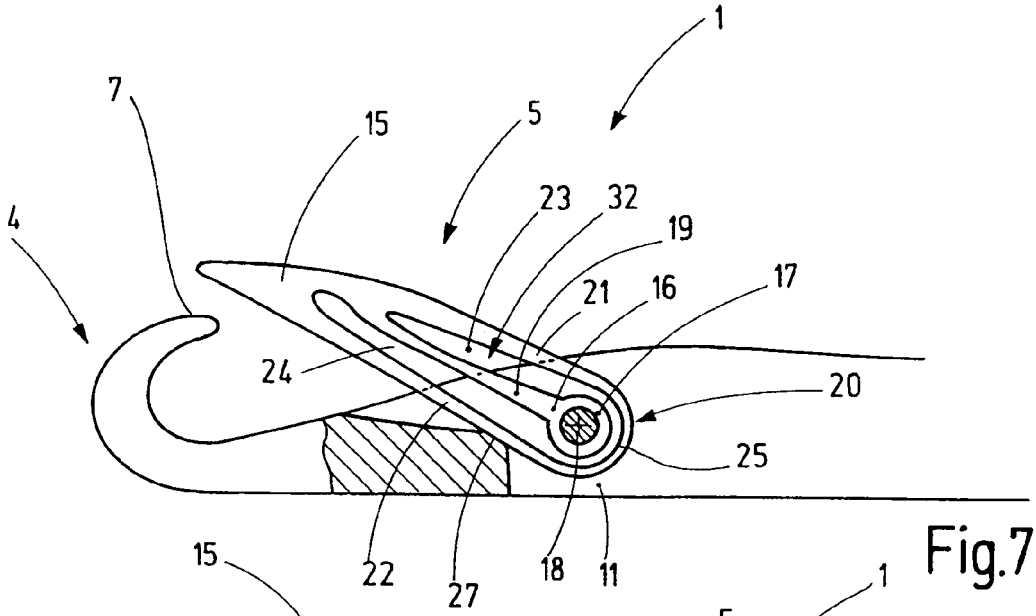

Another modification of the inventive latch needle 1 is shown by FIG. 7. In this case, the strip 19 is slim enough (i.e., the slits 23, 24 are wide enough) for the strip 19 itself to become the spring element. Consequently, the needle tongue 5 has two spring elements, namely the spring element 20 consisting of the legs 21, 22 and the connecting strip 25, as well as a second spring element 32 consisting of the strip 19. Together, the two spring elements 20, 32 provide a relatively soft spring which, in addition, makes it possible to achieve large distances between the head 15 and the tip 7 when the needle tongue 5 is in its relaxed rest position. It is also possible to design the legs 21, 22 and the connecting section 25 so as to be relatively stiff, so that the spring action is provided completely or predominantly only by the spring element 32. As is true of all the other embodiments, a deformation of the tongue 5 occurs between its bearing section 16 and the part of the leg 22 abutting against the abutment surface 27 when the needle tongue 5 is resilient. Other than that, the above description applies analogously.

Figure 8:
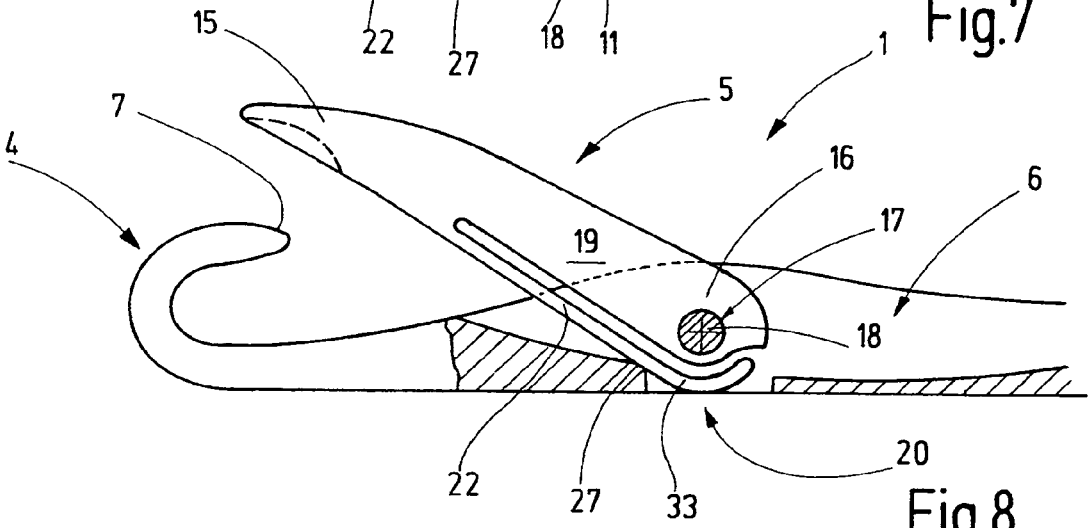
Figure 9:
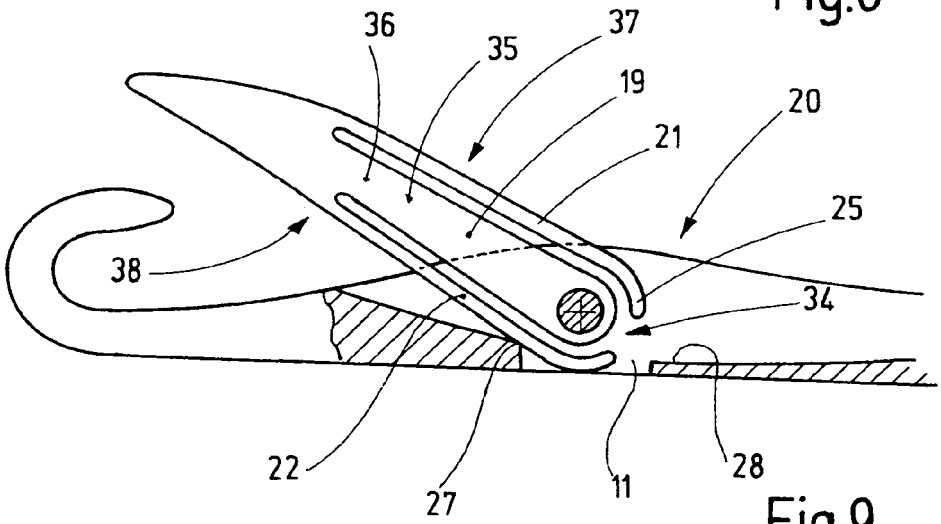

FIG. 8 shows another embodiment of a latch needle with a resilient needle tongue 5. Considering this needle tongue 5, it is special that the spring element 20 consists of a single spring tongue 33. The leg 22 ending near the bearing pin 18 extends from the head 15 parallel to the strip 19. With the use of this configuration, a rest position of the needle tongue 5 in accordance with FIG. 8 is achieved in the vicinity of the closed position. In rear position, the needle tongue 5 is not resilient. To the extent that this should be viewed as a deficiency, such a deficiency is remedied with the embodiment in accordance with FIG. 9. This can be best understood by referring back to the description of the embodiment in accordance with FIGS. 1 through 5, in that, considering this description, the connecting section 25 is provided with a stop 34. At this stop 34, the curved ends or legs 21, 22 are opposite each other at a distance. The abutment surface 27 is associated with the leg 22. The abutment surface 28 is associated with the leg 21. The advantage of this embodiment, compared with the embodiment in accordance with FIGS. 1 through 5, is that the two legs 21 22 that make up the spring element 20 display a lower spring hardness. Other than that, the above description applies analogously.

The latch needle in accordance with the invention comprises a needle tongue with an integrated spring that is configured as the functional element on the needle tongue. No separate tongue spring, whatsoever, need be accommodated on the needle body and in the saw slot. The spring element is no longer associated with the needle body but with the needle tongue. This novel needle concept is robust and suitable for high operating speeds.

It will be appreciated that the above description of the present invention is susceptible to various modifications, changes and modifications, and the same are intended to be comprehended within the meaning and range of equivalents of the appended claims.

LIST OF REFERENCE NUMERALS

1 Latch needle
2 Needle body
3 Foot
4 Hook
5 Needle tongue
6 Saw slot
7 Tip
8, 9 Slot walls
10 Needle back
11 Opening
12 Needle breast
13, 14 End
15 Head
16 Bearing section
17 Bearing opening
18 Pin
19 Strip
20 Spring element
21, 22 Leg
23, 24 Slit
25 Connecting section
26 Arcuate slit
27, 28 Abutment surface
29 Thread
30 Opening
31 Strip
32 Spring element
33 Spring tongue
34 Stop
35, 36 Flat side
37 Tongue back
38 Inside edge

What is claimed is:

1. Latch needle comprising a needle body on which a needle tongue is movably supported on a bearing, and wherein the needle tongue comprises:

a bearing section having a bearing opening mounted on the bearing and a head which is connected to the bearing section; and at least one spring element that is formed by a portion of the needle tongue, that extends, starting from the head, to the bearing section, and that extends around the bearing section back to the head.

2. Latch needle in accordance with claim 1, wherein the spring element consists of the same material as the remainder of the needle tongue and is seamlessly connected in one piece to said needle tongue.

3. Latch needle in accordance with claim 1, wherein a portion of the needle tongue connecting the bearing section to the head forms a further spring element.

4. Latch needle in accordance with claim 1, wherein the spring element is a flexible spring.

5. Latch needle in accordance with claim 1, wherein the needle body has a saw slot in which the needle tongue is pivotally supported on the bearing, and wherein at least one abutment means is provided in the saw slot, with said abutment means coming into contact with the needle tongue before it reaches an end position.

6. Latch needle in accordance with claim 1 wherein the at least one spring element is defined by a U-shaped recess formed through the needle tongue with its open end facing toward the head and its closed end extending around the bearing opening.

* * * * *